US010092806B2

(12) United States Patent
Abe

(10) Patent No.: US 10,092,806 B2
(45) Date of Patent: Oct. 9, 2018

(54) IRON TYPE GOLF CLUB HEAD

(71) Applicant: Dunlop Sports Co. Ltd., Kobe-shi, Hyogo (JP)

(72) Inventor: Hiroshi Abe, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/622,826

(22) Filed: Jun. 14, 2017

(65) Prior Publication Data

US 2018/0001169 A1 Jan. 4, 2018

(30) Foreign Application Priority Data

Jun. 30, 2016 (JP) ..... 2016-130587

(51) Int. Cl.

| | |
|---|---|
| ***A63B 53/04*** | (2015.01) |
| ***A63B 53/06*** | (2015.01) |
| ***A63B 60/02*** | (2015.01) |
| *A63B 102/32* | (2015.01) |

(52) U.S. Cl.

CPC ..... *A63B 60/02* (2015.10); *A63B 53/047* (2013.01); *A63B 2053/0433* (2013.01); *A63B 2053/0491* (2013.01); *A63B 2102/32* (2015.10)

(58) Field of Classification Search

CPC ..... A63B 60/02; A63B 53/047; A63B 2053/0491; A63B 2102/32; A63B 2053/0433

USPC ..... 473/324–350, 287–292; 43/287–292

See application file for complete search history.

(56) References Cited

U.S. PATENT DOCUMENTS

| | | | | | |
|---|---|---|---|---|---|
| 1,538,312 | A | * | 5/1925 | Beat | A63B 53/08 473/335 |
| 2,332,342 | A | * | 10/1943 | Reach | A63B 53/04 473/248 |
| 4,667,963 | A | * | 5/1987 | Yoneyama | A63B 53/04 473/348 |
| 5,050,879 | A | * | 9/1991 | Sun | A63B 53/04 473/338 |
| 5,439,223 | A | * | 8/1995 | Kobayashi | A63B 53/04 473/334 |
| 5,564,705 | A | * | 10/1996 | Kobayashi | A63B 53/04 473/334 |

(Continued)

FOREIGN PATENT DOCUMENTS

| | | |
|---|---|---|
| JP | 5824591 B1 | 11/2015 |
| JP | 2016-120264 A | 7/2016 |

*Primary Examiner* — Sebastiano Passaniti

(74) *Attorney, Agent, or Firm* — Birch, Stewart, Kolasch & Birch, LLP

(57) ABSTRACT

An iron-type golf club head 4 comprises: a head main body 10 including a face 2, a hosel 6, a sole 4 and a back portion 9 extending upward from the trailing edge Te of the sole; and a weight member 20 having a specific gravity larger than the head main body. The face 2 is provided with score lines 7 extending in the toe-heel direction of the head. The weight member 20 is disposed in the sole and extends in the toe-heel direction across a position in the toe-heel direction corresponding to the center position FC of the score lines. The weight member 20 includes a toe-side first portion 21 extending over the sole 4 and the back portion 9, and a heel-side second portion 22 extending within the sole 4.

11 Claims, 14 Drawing Sheets

(56) References Cited

U.S. PATENT DOCUMENTS

| | | | | |
|---|---|---|---|---|
| 5,599,243 | A * | 2/1997 | Kobayashi | A63B 53/04 473/335 |
| 5,613,917 | A * | 3/1997 | Kobayashi | A63B 53/04 473/335 |
| 7,976,403 | B2 * | 7/2011 | Gilbert | A63B 53/0475 473/309 |
| 2003/0139226 | A1 * | 7/2003 | Cheng | A63B 53/04 473/334 |
| 2015/0297958 | A1 | 10/2015 | Hebreo et al. | |

* cited by examiner

IRON TYPE GOLF CLUB HEAD

TECHNICAL FIELD

The present invention relates to an iron type golf club head comprising a head main body and a weight member, more particularly to a structure including the weight member which is capable of shifting the sweet spot of the club face closer to a center position of score lines and at the same time capable of lowering and deepening the center of gravity of the golf club head.

BACKGROUND ART

Japanese Patent No. 5824591 (Patent Document 1) and U.S. Patent Application Publication No. 2015-0297958 (Patent Document 2) disclose iron-type golf club heads each comprising a head main body (including a face, a hosel, a sole and a back portion) and two separate weight members. The weight members are respectively disposed in a toe-side part and a heel-side part of the sole so that the head is provided with a large moment of inertia and a lowered center of gravity.

SUMMARY OF THE INVENTION

Problems to be Solved by the Invention

In general, an iron-type golf club head is provided on the heel-side with a hosel portion to which a shaft is attached. The hosel portion has a relatively large mass. Therefore, the center of gravity of the iron-type golf club head is located on the heel-side of a center position of score lines. As a result, a sweet spot is also located on the heel-side of the center position of the score lines.

Meanwhile, a golfer usually will attempt to hit a ball at the center position of the score lines which is easy-to-understand visually. However, in the iron-type golf club heads, as the sweet spot is located on the heel-side of the center position of the score lines, when a golfer hits a ball at the center position of the score lines, the ball hitting position is deviated from the sweet spot toward the toe. Accordingly, it is difficult to increase the flying distance of the hit ball.

It is therefore, an object of the present invention to provide an iron type golf club head, in which the sweet spot can be shifted in the toe-heel direction toward the center position of the score lines, and the center of gravity of the head can be deepened and lowered.

According to the present invention, an iron-type golf club head comprises:

a head main body including a face, a hosel, a sole and a back portion extending upward from the trailing edge of the sole, and a weight member having a specific gravity larger than the head main body, wherein the face is provided with score lines extending in the toe-heel direction of the head, the weight member is disposed in the sole and extends in the toe-heel direction across a position in the toe-heel direction corresponding to the center position of the score lines, and the weight member integrally includes a toe-side first portion extending over the sole and the back portion, and a heel-side second portion positioned on the heel-side of the toe-side first portion and extending within the sole.

In this application including the description and claims, dimensions, positions, directions and the like relating to the club head refer to those under a standard state of the club head unless otherwise noted.

The "standard state" is, as shown in FIG. 14, a state of the golf club head 1 which is set on a horizontal plane HP such that the center line Z of a shaft insertion hole 8 of the golf club head (corresponding to the club shaft center line) is positioned in a vertical plane VP perpendicular to the horizontal plane HP, and score lines 7 formed in a face 2 become in parallel with the horizontal plane HP, and in parallel with the vertical plane VP.

The term "up-down direction" means a direction perpendicular to the horizontal plane HP.

The toe-heel direction means a direction in parallel with the horizontal plane HP and in parallel with the vertical plane VP.

The term "front-back direction" means a direction in parallel with the horizontal plane HP and perpendicular to the vertical plane VP.

Incidentally, as shown in FIG. 14, "front" of the golf club head 1 means a side of the face 2 which strikes a golf ball, and "rear" means the opposite side thereto. In view of the custom of the golf industry, "rear" and "rear side" of the golf club head may be referred to as "back" and "back side", respectively. Further, "up" with regard to the golf club head 1 is defined as a direction away from the horizontal plane HP or a position distant from the horizontal plane HP, relatively. On the other hand, "low" with regard to the golf club head 1 is defined as a direction closer to the horizontal plane HP or a position closer to the horizontal plane HP, relatively. In view of the custom of the golf industry, a "lower surface" of the golf club head may be referred to as a "bottom surface".

The center position of the score lines means the center position in the toe-heel direction of the longest one of the score lines formed in the club face so as to extend parallel with the toe-heel direction.

The sweet spot is a point of intersection of the club face and a straight line drawn perpendicularly to the club face from the center of gravity of the head. Incidentally, when the ball hitting position is closer to the sweet spot, the higher rebound effect can be obtained.

The depth of the center of gravity means the distance measured from the face to the center of gravity of the head perpendicularly to the face. Thus, the deeper center of gravity is more distant from the face.

The term "up-down moment of inertia" means a moment of inertia about a horizontal axis passing through the center of gravity of the head in parallel with the toe-heel direction.

The term "horizontal moment of inertia" means a moment of inertia about a vertical axis passing through the center of gravity of the head.

The expression "forward tilted state" used hereinafter means a state of the golf club head 1 in which the golf club head 1 in the standard state is tilted forward around a horizontal axis extending in parallel with both the horizontal plane HP and the standard vertical plane VP so that the face 2 becomes in parallel with the vertical plane VP.

Therefore, in the iron type golf club head according to the present invention, the center of gravity of the head is lowered by the weight member. The lowered center of gravity can lowers the position of the sweet spot, therefore, the ball launch angle of the face at the time of striking a ball can be suppressed from decreasing. This helps to increase the flying distance of the hit ball.

The toe-side first portion of the weight member which extends into the back portion, can allocate the mass to the back portion to deepen the center of gravity. The deepened center of gravity can increase the up-down moment of inertia of the head. Thus, even if the ball hitting positions are varied in the up-down direction, the ball launch angles are stabilized. As a result, the high-rebound ball hitting area of the face can be expanded.

The heel-side second portion of the weight member which is disposed within the sole without protruding into the back portion, can prevent the center of gravity of the head from shifting toward the heel. This can prevent the sweet spot from shifting toward the heel further away from the center position of the score lines which position is considered as the normal striking position by the golfers.

As described above, in the iron type golf club head according to the present invention, it is possible to shift the sweet spot in the toe-heel direction toward the center position of the score lines, and deepen and lower the center of gravity of the head.

Further, the iron-type golf club head according to the present invention may include the following features (1)-(4):

(1) the weight member comprises a base plate part extending in the toe-toe-heel direction of the head, while gradually increasing the width in the front-back direction of the head toward the toe of the head from the heel side, and forming a part of the sole, and a rising part extending upward from a toe-side portion of the base plate part, and forming a part of the back portion;

(2) a thickness of the rising part is larger than a thickness of the base plate part;

(3) the rising part has an upper edge whose contour is smoothly and convexly curved upward, and the highest point of the contour is positioned on the toe-side of the center position of the score lines;

(4) the boundary between the first portion and the second portion is positioned on the heel-side of the center position of the score lines.

DESCRIPTION OF THE PREFERRED EMBODIMENTS

Embodiments of the present invention will now be described in detail in conjunction with accompanying drawings.

Figure 1:
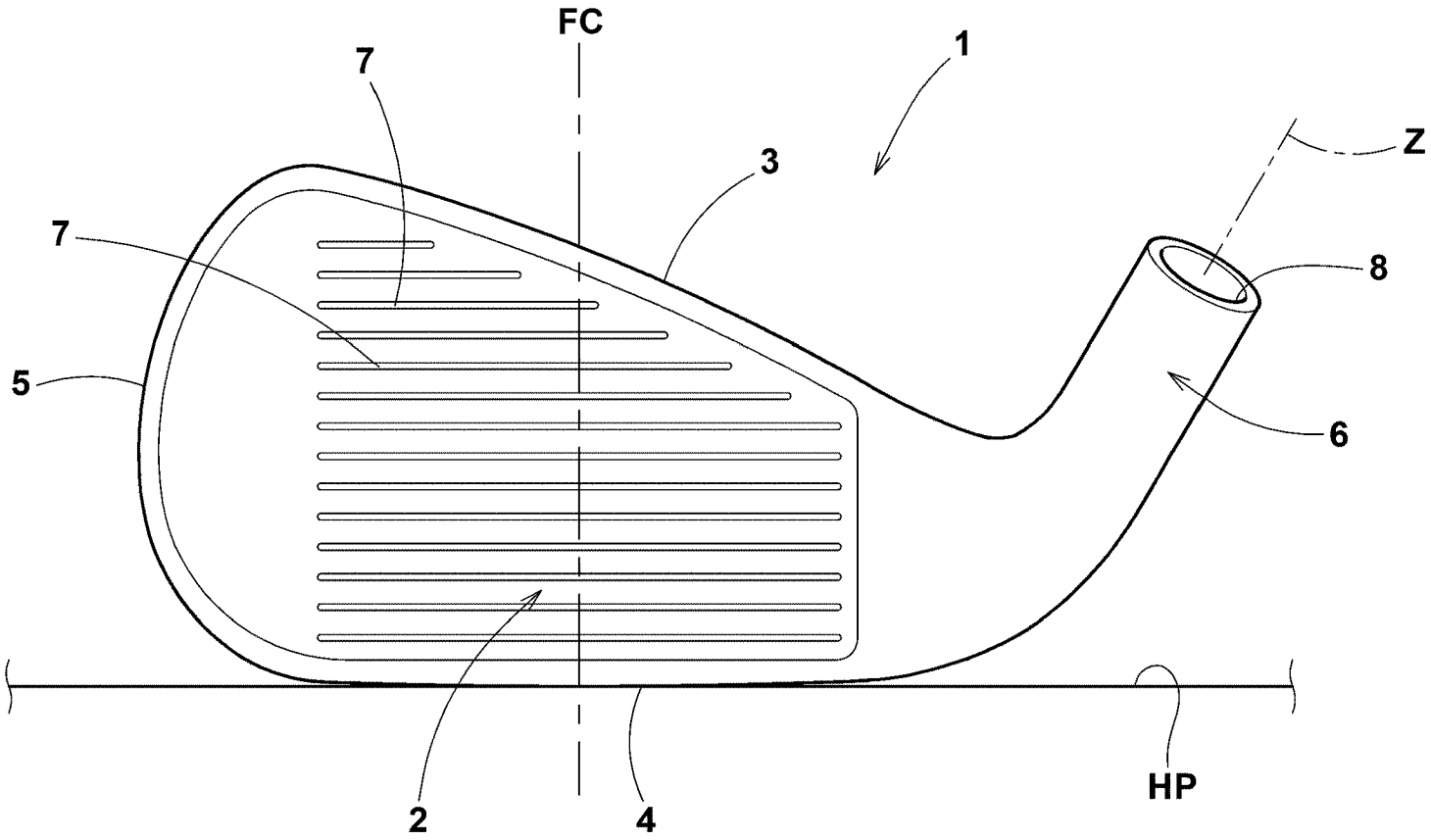
FIG. 1 is a front view of an iron type golf club head as an embodiment of the present invention.
Figure 2:
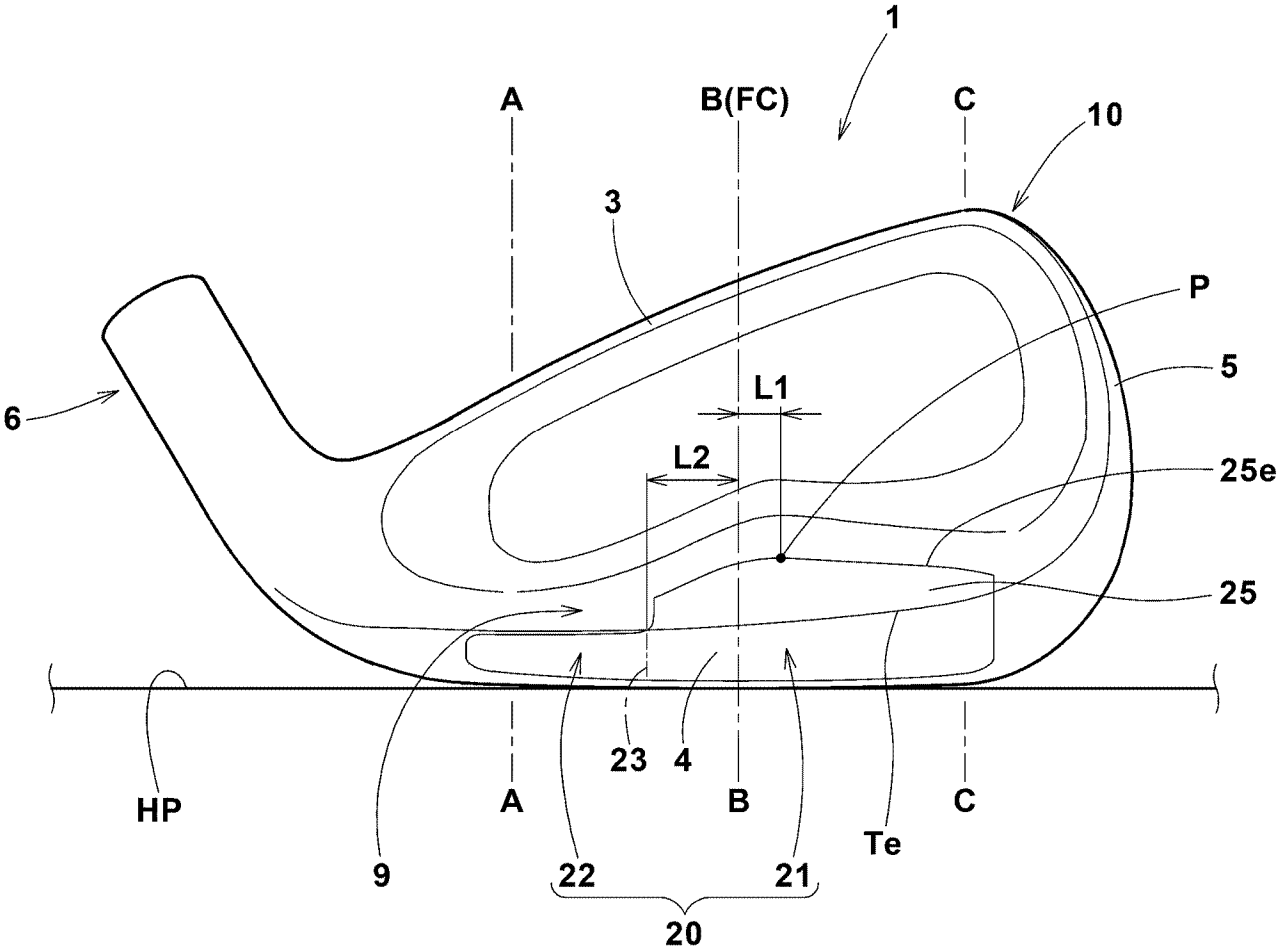
FIG. 2 is a rear view thereof.

FIGS. 1-6 shows an iron type golf club head 1 as a first embodiment of the present invention. In FIGS. 1 and 2, the head 1 is in the forward tilted state. In FIGS. 3 and 4(A)-4(C), the head 1 is in the standard state.

As shown in FIGS. 1-6, the golf club head 1 in this embodiment has a shape typical of the iron-type, and comprises a face 2, a top 3, a sole 4, a toe 5, a hosel 6 and a back portion 9.

The face 2 is a substantially flat face for striking a golf ball. The face 2 is provided with score lines 7 in order to increase friction on the golf ball surface.

The score lines 7 extend in parallel with the toe-heel direction of the golf club head 1.

The top 3 is an upper surface portion of the golf club head 1 extending backward from an upper edge of the face 2.

The sole 4 is a portion between a leading edge Le and a trailing edge Te.

The leading edge Le is defined as a part in which the face 2 and the sole 4 intersect.

In a cross section of the head 1 which is orthogonal to both the above-mentioned vertical plane VP and the horizontal plane HP, the trailing edge Te is defined as a position at which the sole 4 and the back portion 9 intersect. If the position can be identified by a clear edge in the appearance, the trailing edge Te is defined by the identified edge. If the position is not clear from the appearance, then, by measuring the radius of curvature of the sole 4 from the leading edge Le side toward the rear of the head, a position at which the radius curvature firstly becomes less than 15 mm is determined, and the trailing edge Te is defined by the determined position.

The toe 5 is a portion located most distant from the hosel 6 and smoothly connecting between the top 3 and the sole 4.

The hosel 6 is a part provided with a shaft insertion hole 8 into which a tip end of a golf club shaft (not shown) is attached, and formed as a tubular upwardly protruding part for example. Incidentally, the center line Z of the shaft insertion hole 8 substantially coincides with the center line of the golf club shaft.

The golf club head 1 is composed of a head main body 10 and a weight member 20.

The head main body 10 constitutes a major portion of the golf club head 1.

The head main body 10 in the first embodiment comprises the face 2, the top 3, the sole 4, the toe 5, the hosel 6 and the back portion 9 as shown in FIGS. 4(A)-4(C), 5 and 6.

For example, the head main body 10 is made of metal materials.

Figure 5:
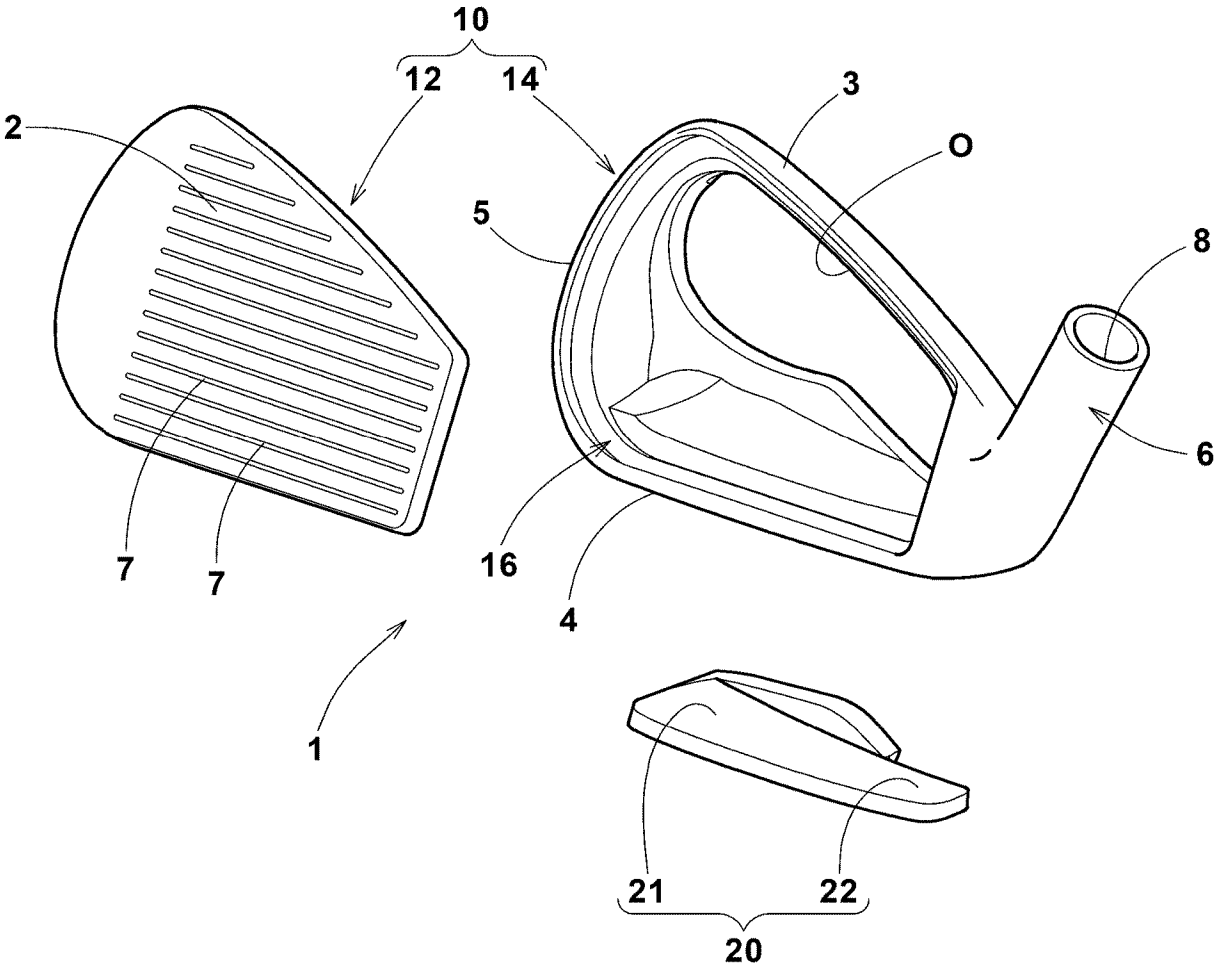
FIG. 5 is an exploded perspective view of the iron type golf club head viewed diagonally from the front.

The head main body 10 is preferably composed of a face plate 12 and a face plate receiving part 14 as shown in FIG. 5. Preferably, the face plate 12 and the face plate receiving part 14 are made of different metal materials.

The face plate 12 is made of a metal material having the smallest specific gravity among the metal materials constituting the golf club head 1. Thereby, the center of gravity of the head can be positioned more downward and backward.

For example, titanium alloys having a specific gravity of not more than 4.5 and having high specific strength can be preferably used.

The face plate receiving part 14 is provided with a through hole surrounded by the top 3, the sole 4 and the toe 5 and having a front opening O.

The face plate receiving part 14 is provided around the front opening O with a face mounting part 16 to which a peripheral part of the face plate 12 is fixed.

The front opening O is closed by the face plate 12 fixed to the face mounting part 16.

In order to fix the face plate 12 to the face plate receiving part 14, various techniques, for example, welding, brazing, soldering, adhesive bonding, caulking, press fitting etc. can be used alone or in combination.

The face plate receiving part 14 is formed integrally with the above-mentioned hosel 6.

The face plate receiving part 14 is preferably made of an iron-based alloy having a basic strength and good processability such as stainless steel and carbon steel. Specifically, iron-based alloys having a specific gravity of more than 7.0, preferably more than 7.5 are preferably used. As described above, when the face plate receiving part 14 is made of the metal material whose specific gravity is higher than the face plate 12, the center of gravity of the head can be positioned more downward and backward.

It is also possible to form the head main body 10 from a single material or three or more different materials.

When the head main body 10 is formed from a single material, a typical example of the head main body 10 is such that the face plate 12 and the face plate receiving part 14 are integrally formed as one piece through a technique, e.g. machining, casting, lasering and the like.

Another example of the head main body 10 is one having a multi-piece structure in which the face plate 12 and the face plate receiving part 14 made of the same material are integrally fixed to each other.

A typical example of the head main body 10 formed from three or more different materials is one having a multi-piece structure in which the face plate 12 is integrally fixed to the face plate receiving part 14 composed of two or more parts made of different materials. In this case, the face plate 12 and the parts constituting the face plate receiving part 14 are made of three or more different materials.

The head main body 10 is provided with a recess 18 recessed from the outer surface of the head having its finished shape as shown in FIGS. 4(A)-4(C) and 6.

The recess 18 provides a recessed space surrounded by a bottom wall 18*a* and a surrounding wall 18*b* surrounding the bottom wall 18*a*.

In this embodiment, by disposing the weight member 20 in the recess 18, the finished shape of the golf club head 1 is obtained.

It is desirable to form the recess 18 in a position other than the face 2. If a part of the face 2 is formed by the face plate 12, the recess 18 is formed in a position other than the face plate 12. The recess 18 in this embodiment is formed in the sole 4, more specifically, in the sole of the face plate receiving part 14 so as to elongate in the toe-heel direction.

Figure 6:
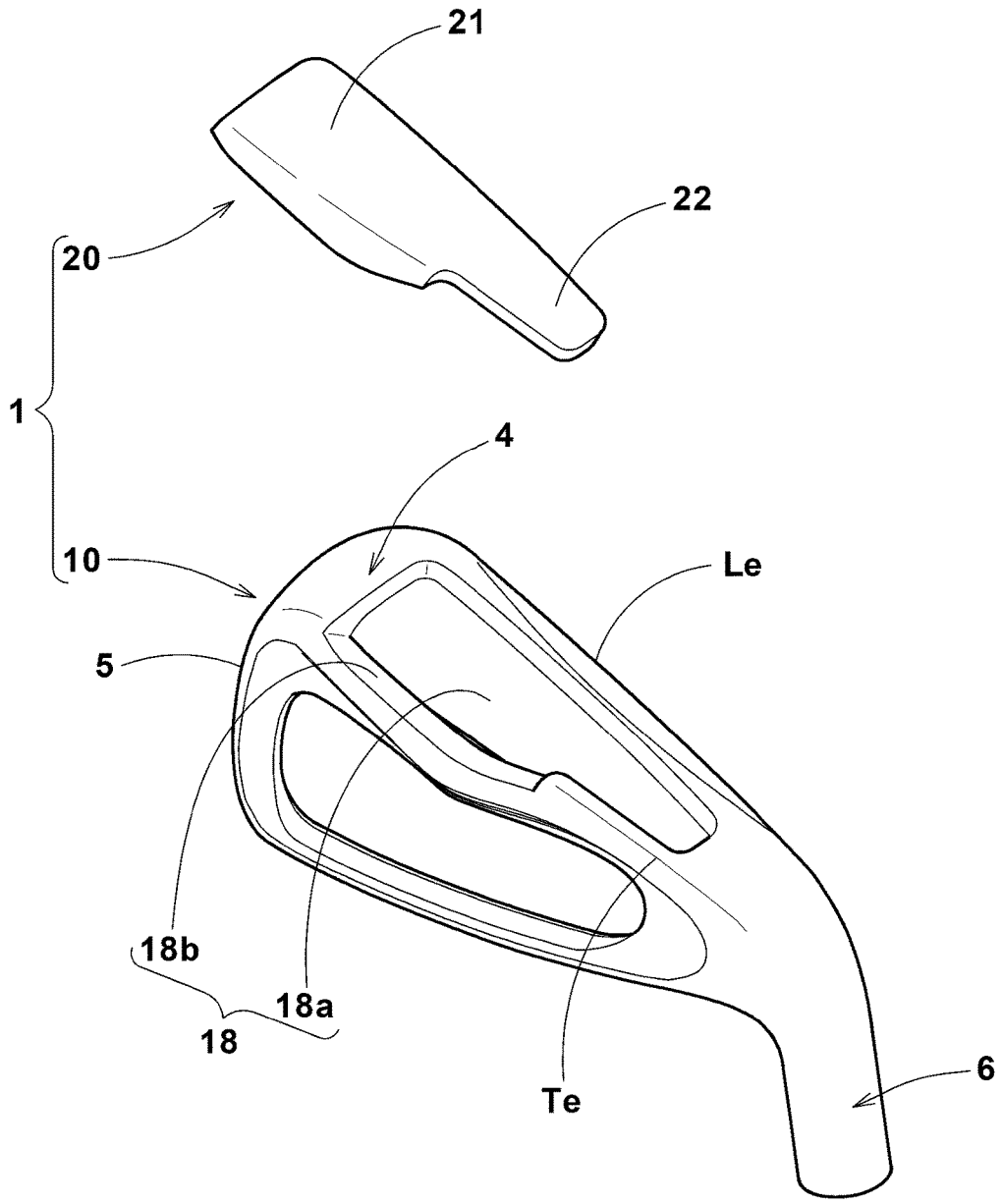
FIG. 6 is an exploded perspective view of the golf club head viewed diagonally from the under side. 6 is an exploded perspective view of the golf club head viewed diagonally from the under side.

As shown in FIG. 5 and FIG. 6, the weight member 20 is disposed in the recess 18 formed in the sole 4. The weight member 20 disposed in the sole 4 extends in the toe-heel direction.

The weight member 20 is made of a metal material having a specific gravity greater than that of the head main body 10. Such weight member 20 has a large effect on the center of gravity of the head, and it is possible to shift the center of gravity of the head toward the center of gravity of the weight member 20.

In this embodiment, the weight member 20 is exposed in the sole 4. Such arrangement helps to further lower the center of gravity.

If the head main body 10 is made of one kind of material, the specific gravity of the head main body 10 can be obtained as the specific gravity of the material. If the head main body 10 is composed of a plurality of parts having different specific gravity values, the specific gravity of the head main body 10 can be obtained as a weighted arithmetic average by averaging the specific gravity values of the parts which are respectively weighted by the volumes of the parts.

Preferably, the weight member 20 is made of a tungsten-nickel-iron alloy comprising W, Ni and Fe. Such alloy can be increased in the specific gravity by increasing the content of the tungsten W relatively to the content of the iron Fe. However, due to the relatively decreased content of the iron, such alloy is decreased in the weldability to an iron based alloy such as soft iron and stainless steel.

In this embodiment, the weight member 20 is made of the tungsten-nickel-iron alloy which is increased in the specific gravity by increasing the content of the tungsten W within a range in which the alloy can be welded with the head main body 10. Preferably, the specific gravity of the weight member 20 is set in a range from 8.0 to 10.0.

Figure 7:
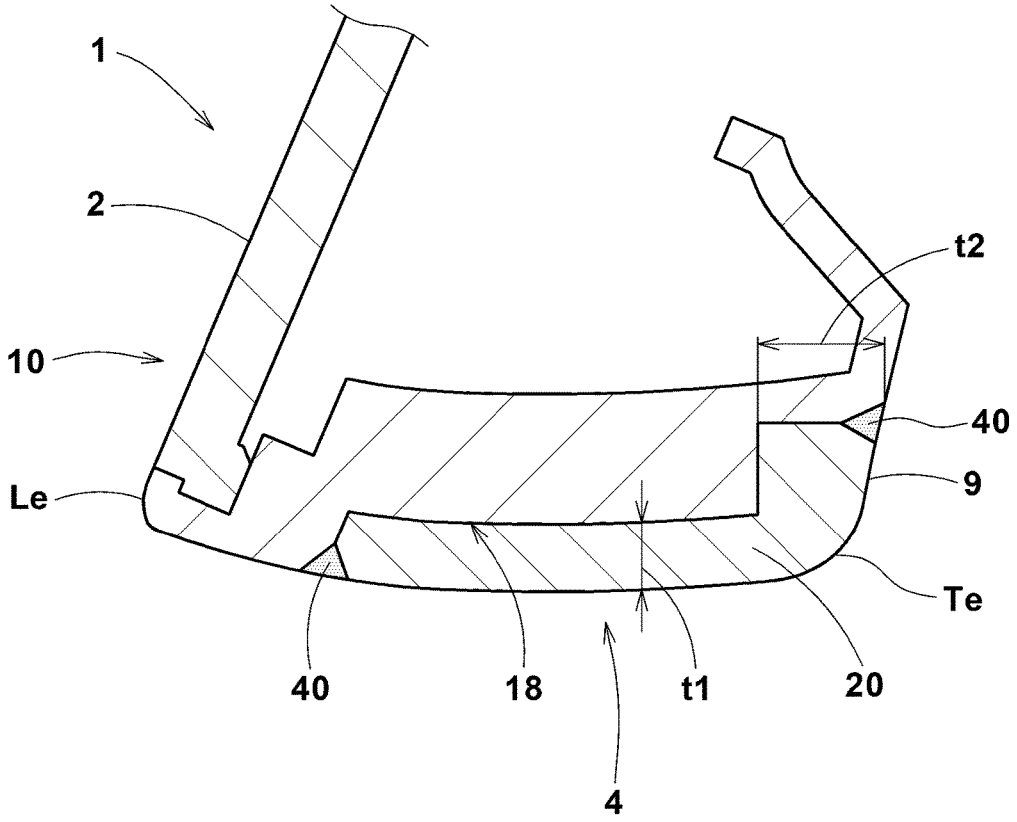
FIG. 7 is a closeup of FIG. 4(B).

The peripheral edge of the weight member 20 is welded to the head main body 10 (in this example, welded to the recess 18) as shown in FIG. 7. In order to increase the joint strength, the entire length of the peripheral edge is welded to the head main body 10. In FIG. 7, reference numeral 40 denotes the weld bead.

Figure 3:
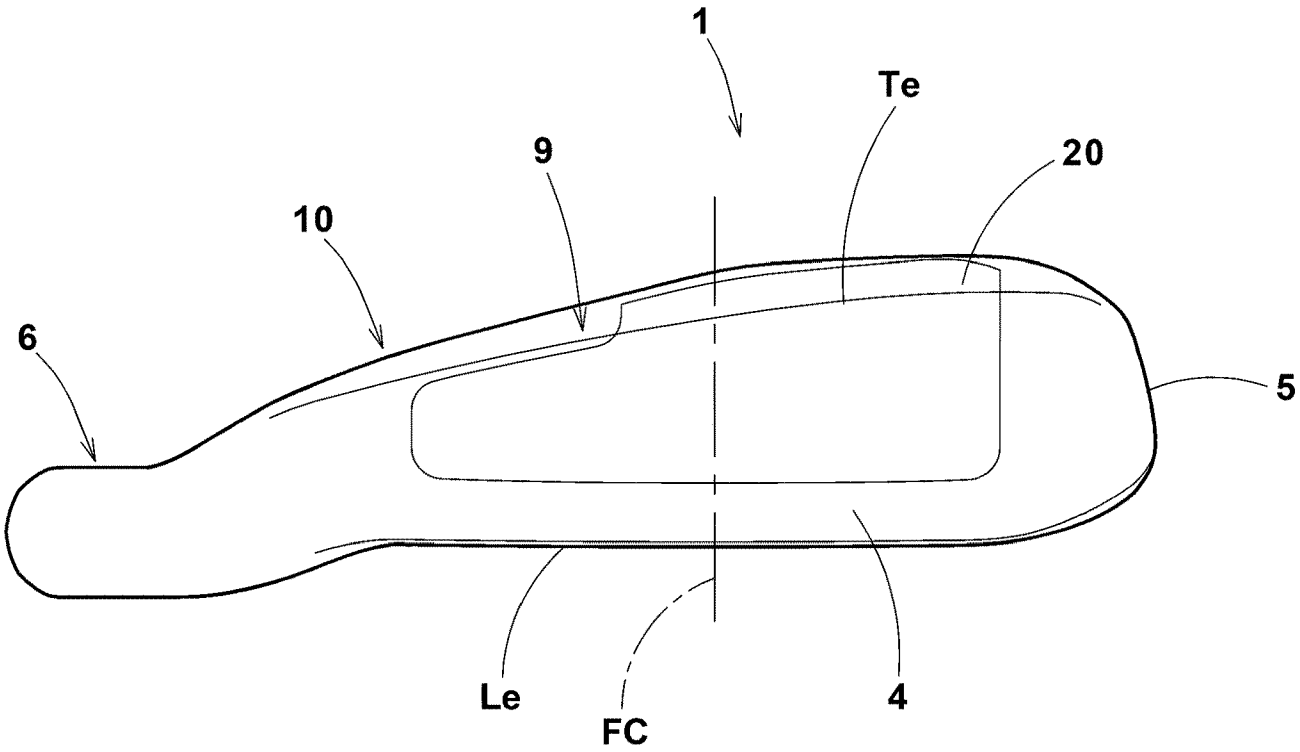
FIG. 3 is a bottom view thereof.
Figure 4C:
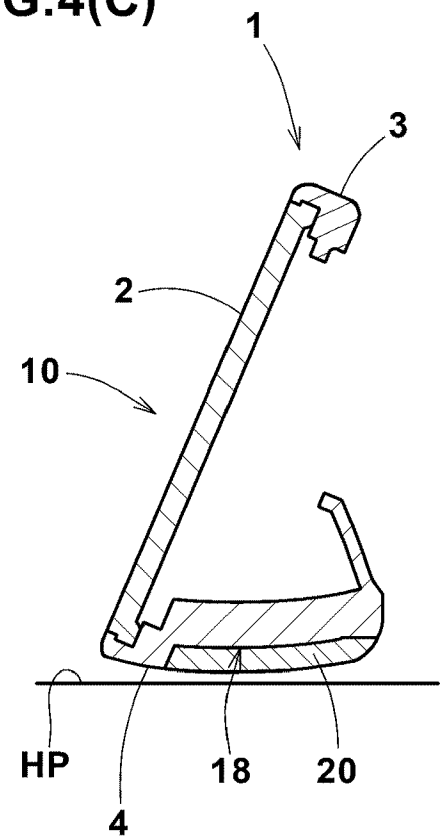
FIGS. 4(A), 4(B) and 4(C) are sectional views of the iron-type golf club head under its standard state taken along line A-A, line B-B line and line C-C of FIG. 2, respectively.
Figure 4B:
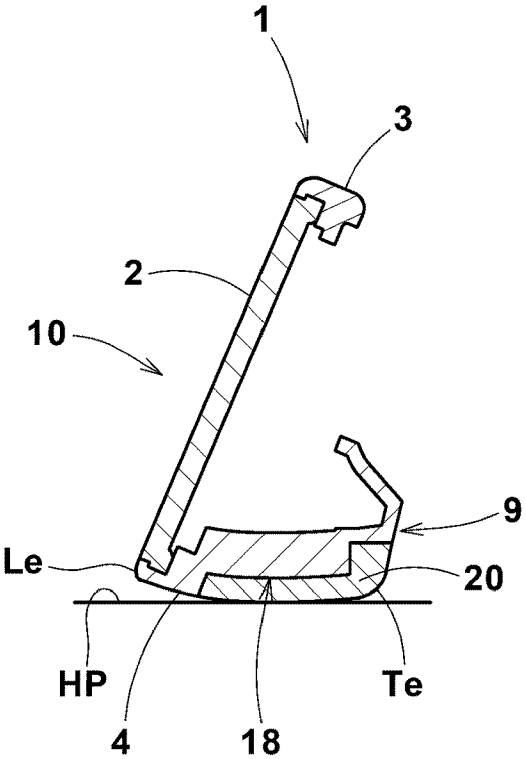
Figure 4A:
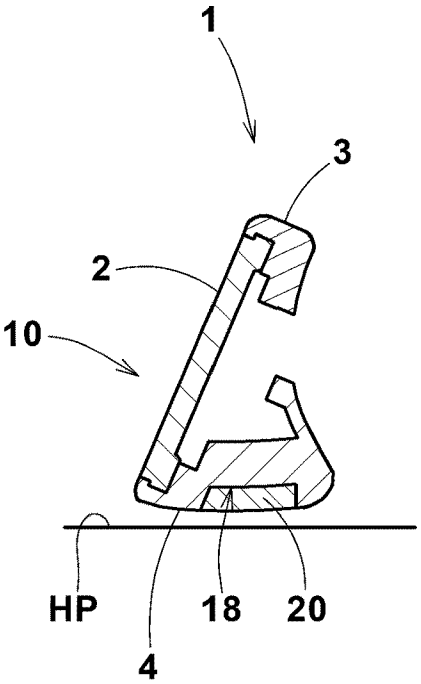

As shown in FIGS. 2 and 3, the weight member 20 extends in the toe-heel direction across a position in the toe-heel direction which corresponds to the above explained center position FC of the score lines 7 in order to allocate the mass to not only the bottom of the head 1 but also to the toe-side and heel-side of the head 1 as well.

Thus, the golf club head 1 can be provided with the lowered center of gravity, and the increased horizontal moment of inertia.

The weight member 20 has a toe-side first portion 21 and a heel-side second portion 22 located on the heel-side of the first portion 21 as shown in FIGS. 2 and 3.

The toe-side first portion 21 extends over the sole 4 and the back portion 9. Such toe-side first portion 21 allocates the mass to the backward of the head, and increases the depth of the center of gravity. The increased depth of the center of gravity increases the up-down moment of inertia of the golf club head 1. Therefore, even if the ball strike position is off the sweet spot in the up-down direction, launch angles of the hit balls are stabilized. As a result, the high-rebound ball hitting area of the face 2 is expanded.

In this embodiment, the toe-side first portion 21 is exposed in the outer surface of the head in the back part 9, therefore, it is possible to place the weight member backwardly of the head.

The heel-side second portion 22 extends within the sole 4 without protruding into the back portion 9. In other words, the heel-side second portion 22 does not extend upwardly beyond the trailing edge Te, therefore, it is compact when compared with the toe-side first portion 21. Thus, the mass of the weight member allocated to the heel-side becomes less in order to prevent the center of gravity of the head from shifting toward the heel. This can prevent the sweet spot from shifting toward the heel further away from the center position FC of the score lines.

In such golf club head 1, the rebound performance at the center position FC of the score lines 7 which position is the normal striking position for the golfers, can be prevented from deteriorating, and the flying distance of the hit ball can be increased.

Figure 8A:
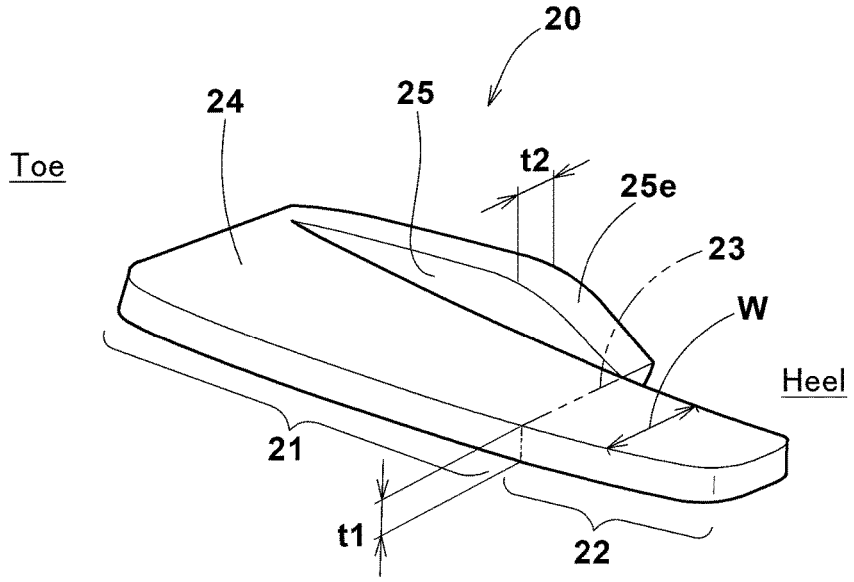
FIGS. 8(A) and 8(B) are exploded perspective views of the weight member.
Figure 8B:
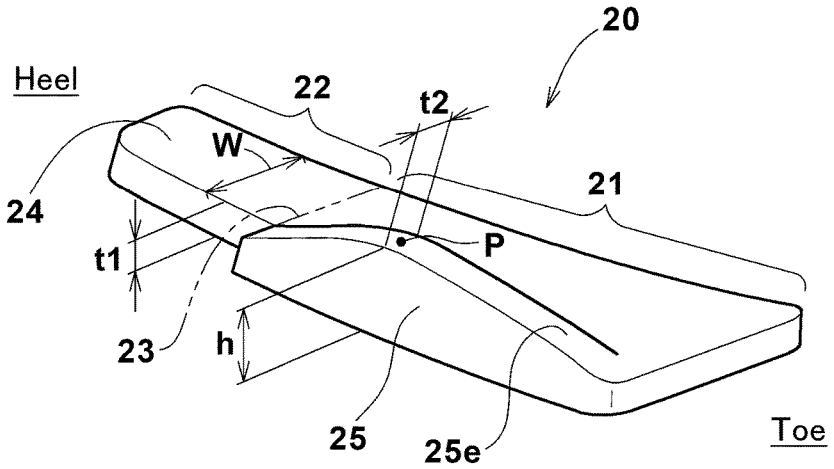

As shown in FIGS. 8(A) and 8(B), the weight member 20 has a base plate part 24 and a rising part 25 which are integrally formed.

The width W in the front-back direction of the base plate part 24 is gradually increased toward the toe from the heel-side, and the base plate part 24 has a substantially trapezoidal shape or substantially triangular shape in the plan view.

Such configuration of the base plate part 24 can increase the mass distribution to the toe-side, while reducing the mass distribution to the heel-side.

Thus, the base plate part 24 can provide an effective mass distribution. This is especially effective to shift the center of gravity of the head toward the toe.

when the weight member 20 is fixed to the head main body 10, the base plate part 24 forms a part of the sole 4.

The thickness t1 of the base plate part 24 can be constant or variable. Preferably, the thickness t1 of the base plate part 24 is increased backward of the head in order to allocate the mass to the backward of the head and thereby to provide the center of gravity increased in the depth. The thickness t1 of the base plate part 24 is preferably set in a range from 1.0 to 4.0 mm.

The rising part 25 extends upward from a toe-side and rear-side portion of the base plate part 24. When the weight member 20 is fixed to the head main body 10, the rising part 25 forms a part of the back portion 9.

The rising part 25 has a sufficient thickness t2 capable of distributing the mass to the backward of the head to increase the depth of the center of gravity. The thickness t2 of the rising part 25 is preferably larger than the thickness t1 of the base plate part 24.

The rising part 25 has a height h in its rear view as shown in FIGS. 8(A) and 8(B). In this embodiment, the height h is varied so that the contour 25*e* of the upper edge of the rising part 25 in the rear view is curved smoothly and convexly toward the upper side to have a mountain shape.

Preferably, in the rear view of the head shown in FIG. 2, the highest position P of the contour 25*e* of the rising part 25 is located on the toe-side of the center position FC of the score lines 7.

Such positional relationship in the toe-heel direction between the highest position P of the contour 25*e* and the center position FC of the score lines 7 which relationship can be found in FIG. 2 showing the golf club head 1 in the forward tilted state, is maintained even in the standard state. According to such design, the center of gravity of the rising part 25 is located on the toe-side of the center position FC of the score lines, and the center of gravity of the head can be positioned close to the center position FC of the score lines.

In order to effectively derive this advantageous effect, it is preferred that the distance L1 in the toe-heel direction between the highest position P of the contour 25*e* of the rising part 25 and the center position FC of the score lines is set in a range from 0.5 to 15 mm.

In the weight member 20, a boundary 23 between the toe-side first portion 21 and the heel-side second portion 22 is located on the heel-side of the center position FC of the score lines.

Here, the boundary 23 is defined by a position in the toe-heel direction at which the weight member 20 first extends beyond the trailing edge Te in the course from the heel to the toe. Accordingly, the toe-side first portion 21 extends in the toe-heel direction across the center position FC of the score lines 7. Such toe-side first portion 21 formed in a wide range in the toe-heel direction can increase the depth of the center of gravity of the head.

If the boundary 23 is located far from the center position FC toward the heel, there is a possibility that the sweet spot is shifted away from the center position FC toward the heel. From this point of view, the distance L2 in the toe-heel direction between the boundary 23 and the center position FC of the score lines is preferably set in a range from 5 to 18 mm in the rear view of the head.

In the golf club head 1 as the first embodiment which employs the above-described configuration, the center of gravity of the head can achieve both the height of 14 to 20 mm and the depth of 4.0 to 10 mm (the height is that from the horizontal plane to the center of gravity of the head in the standard state). Further, in this embodiment, the distance in the toe-heel direction between the sweet spot and the center position FC of the score lines can be preferably set in a range of not more than 10 mm, more preferably not more than 8 mm.

FIGS. 9-13 show an iron type golf club head 1 as a second embodiment of the present invention.

In the following description of the second embodiment, the same or common elements as in the first embodiment are denoted by the same reference numbers, and the detailed descriptions are omitted.

Figure 9:
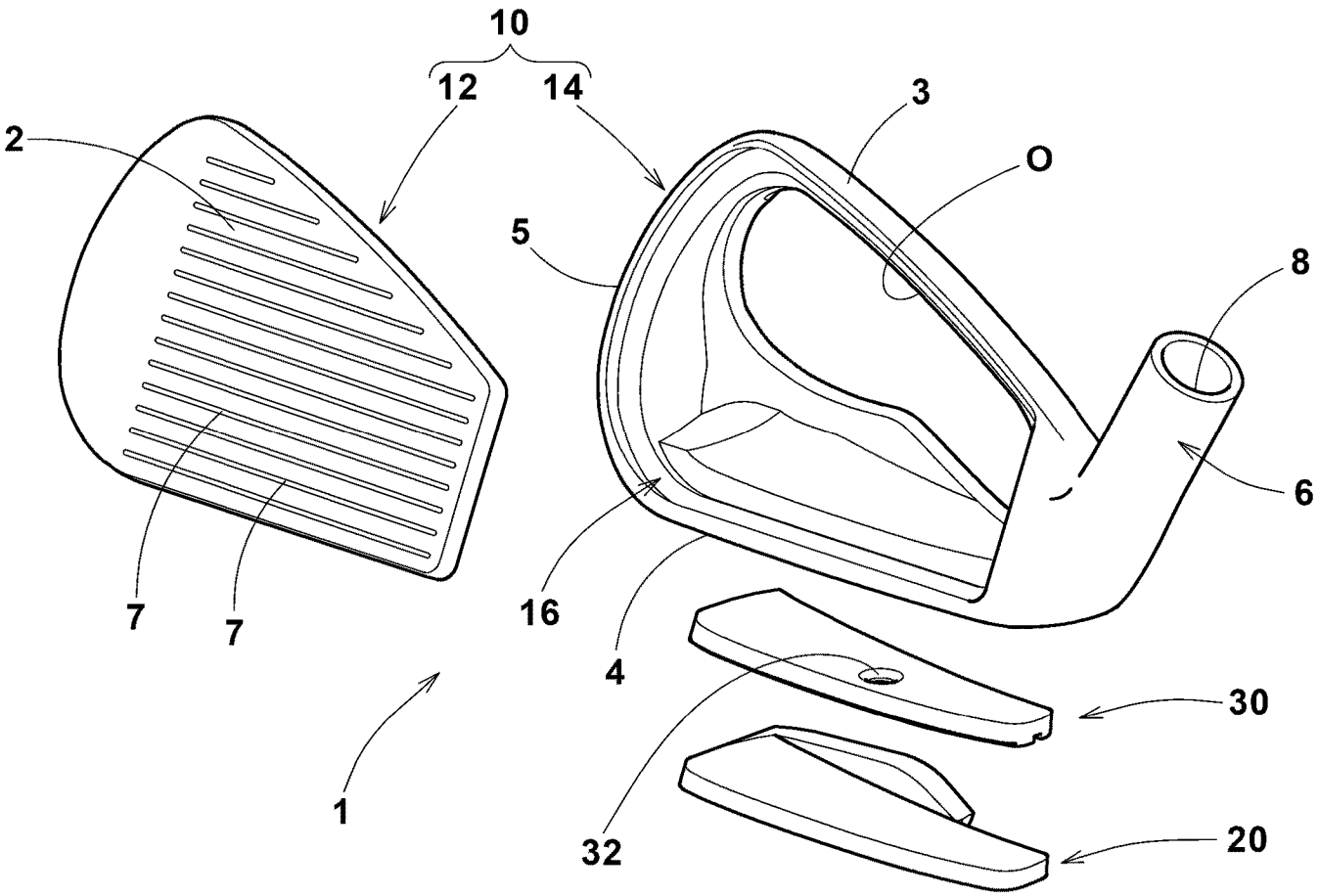
FIG. 9 is an exploded perspective view of an iron type golf club head as another embodiment of the present invention viewed diagonally from the front.
Figure 10:
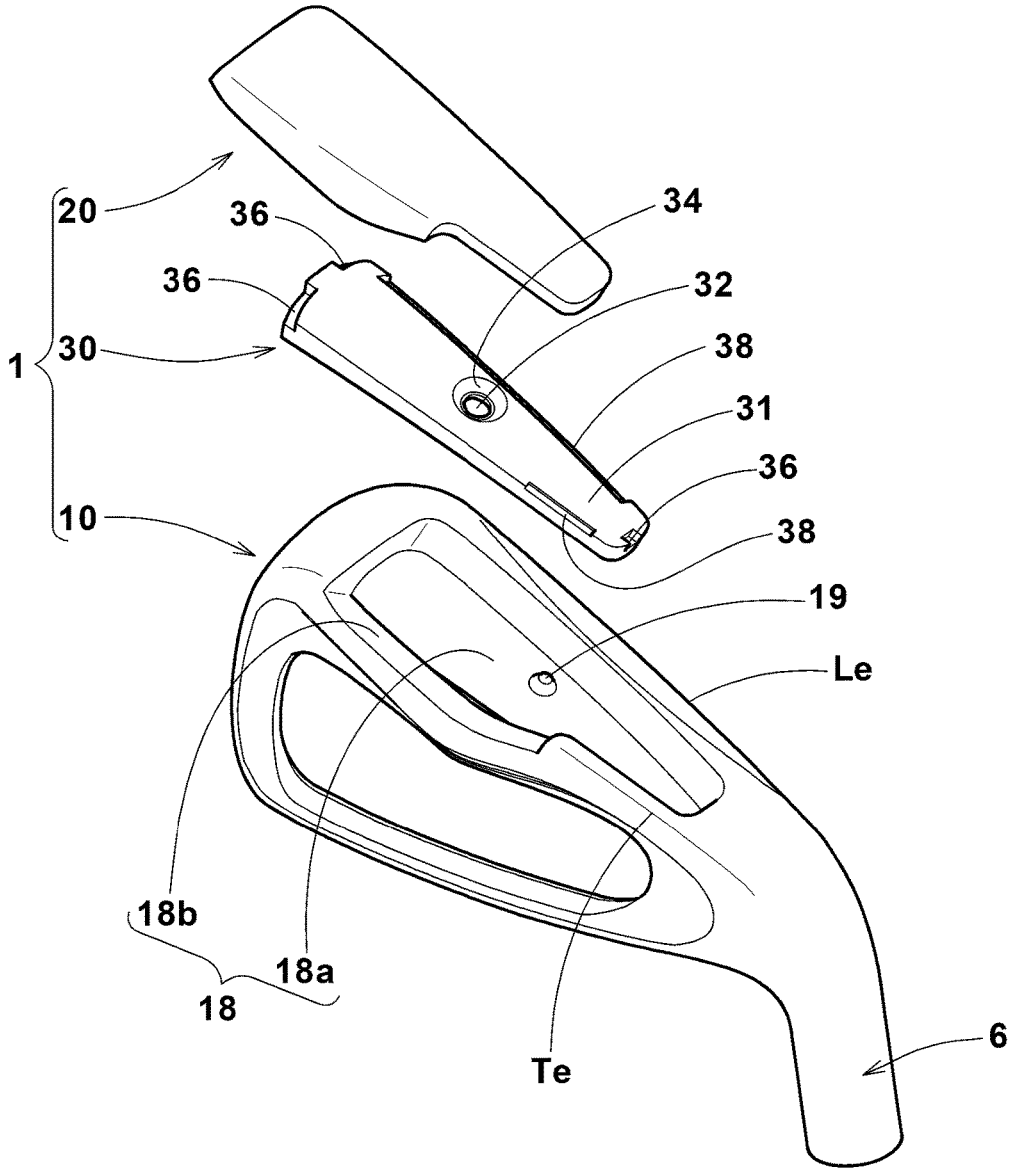
FIG. 10 is an exploded perspective view of an iron type golf club head as still another embodiment of the present invention viewed diagonally from the under side.

The golf club head 1 as the second embodiment comprises the head main body 10 and the weight member 20 as in the first embodiment, and further comprises an insert 30 as shown in FIGS. 9 and 10. The Insert 30 is disposed internally in the head 1 and sandwiched between the head main body 10 and the weight member 20.

The insert 30 is disposed in the recess 18 and has a shape elongated in the toe-heel direction similarly to the recess 18. The insert 30 contacts with the bottom wall 18*a* and the surrounding wall 18*b* of the recess 18 at least partially in order to prevent the insert 30 from moving in the toe-heel direction, front-back direction and upward direction, and serves to suppress the generation of noise due to vibrations of the insert 30 when hitting a ball.

The insert 30 can be made of a material having a different specific gravity than those of the head main body 10 and the weight member 20.

The insert 30 is also capable of utilizing to adjust the center of gravity of the head. Thus, the insert 30 is preferably made of a material having a higher specific gravity than weight member 20. Such insert 30 has a large effect on the center of gravity of the head, and it is possible to shift the center of gravity of the head close to the center of gravity of the insert 30. In the second embodiment, therefore, it is possible to further shift the center of gravity of the head 1 toward the sole 4.

It is not essential but preferable that the specific gravity of the insert 30 is set in a range of not less than 10.0, more preferably not less than 12.0. Preferably, the insert 30 is made of a tungsten-nickel-iron alloy comprising W, Ni and Fe. In this embodiment, the insert 30 is made of the tungsten-nickel-iron alloy whose specific gravity is greatly increased by increasing the content of W such that the alloy can not be welded to the head main body 10. However, it may be preferable that the specific gravity of the insert 30 is not more than 18.5, for example.

Figure 11:
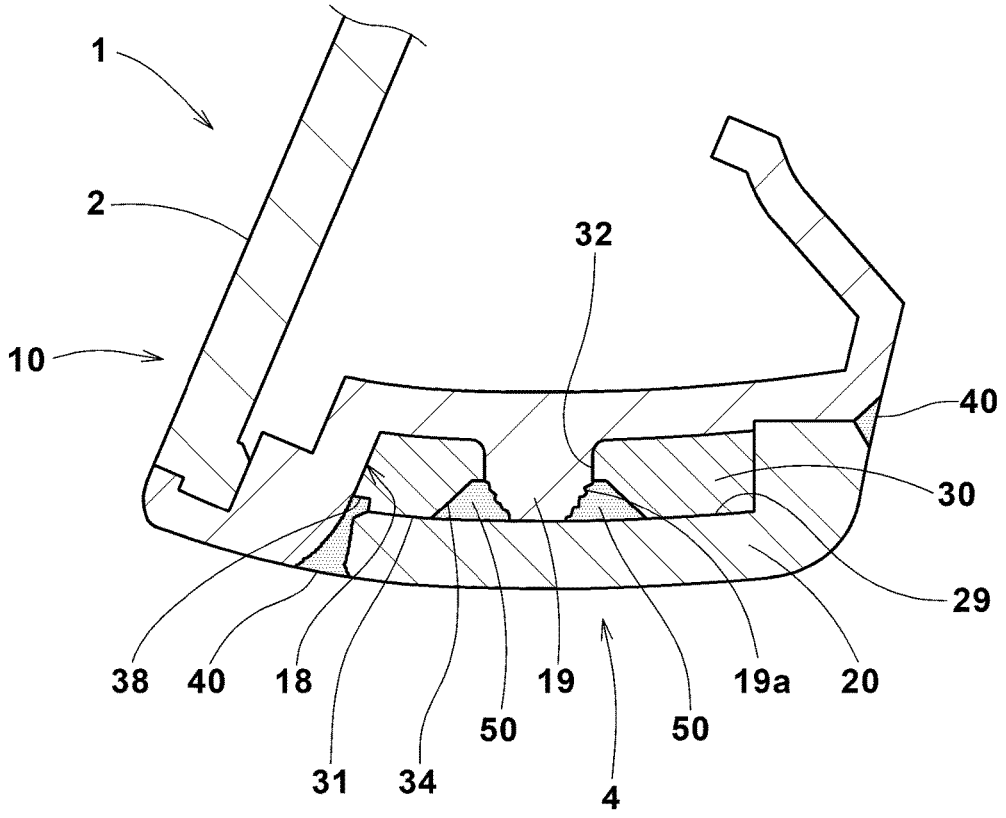
FIG. 11 is a cross-sectional partial view of an iron-type golf club head as still another embodiment of the present invention taken along line corresponding to line B-B of FIG. 2.

FIG. 11 is an enlarged sectional view of the sole area of the golf club head 1 in this embodiment at a position corresponding to the position of the line B-B of FIG. 2.

As shown in FIGS. 9 to 11, the head main body 10 is provided with a convex portion 19 protruding toward the outside of the head. The convex portion 19 in this example is formed in the recess 18, for example, on the bottom wall 18*a* of the recess 18. The convex portion 19 in this example has a substantially cylindrical shape, but it is not limited to such shape.

On the other hand, the insert 30 is provided with a through holes 32.

The insert 30 is disposed on the outer side of the head main body 10 so that the convex portion 19 of the head main body 10 is positioned at the through hole 32.

In this example, the insert 30 is disposed in the recess 18 so that the convex portion 19 is positioned in the through hole 32. The Insert 30 contacts with the wall surface of the recess 18 and the convex portion 19 engages with the through hole 32. Therefore, in the second embodiment, although the insert 30 can not be welded to the head main body 10, vibrations of the insert 30 relative to the head main body 10 can be effectively suppressed, and the occurrence of noise due to vibrations of the insert 30 can be prevented.

In the golf club head 1 as the second embodiment, weld beads 50 for securing the insert 30 to the head main body 10 are formed between the through hole 32 and the convex portion 19 as shown in FIG. 11.

The weld beads 50 fill up the gap formed between the through hole 32 and the convex portion 19, and the friction or mechanical engagement therebetween can restrain relative movements therebetween.

Incidentally, the weld bead 50 is formed by solidifying a molten metal material. In this embodiment, the weld bead 50 is fused with a metal material forming the convex portion 19, namely, the metal material forming the head main body 10. Before being solidified into the weld bead 50, the molten metal material penetrates into fine gaps between the through hole 32 and the convex portion 19, and then the metal material is solidified in a state filling up the gaps and fixed to the convex portion 19.

Thus, even if the weld bead 50 is not united with the insert 30, as the weld bead 50 reduces the gap between the through hole 32 and the convex portion 19, it is possible to more effectively suppress vibrating motions of the insert 30 relative to the head main body 10, i.e., vibrating motions in the protruding direction of the convex portion 19 and the perpendicular direction thereto.

In this embodiment, in order to enhance the effect of the weld beads 50 to restrain the motions of the insert 30, a tapered portion 19*a* is formed in a tip end part of the convex portion 19 so that the gap increasing toward the outer surface of the head is formed between the tapered portion 19*a* and the inner surface of through hole 32.

Such gap can be utilized as a groove formed in advance of welding joint, and it is possible to fill it with an adequate amount of the molten metal material. Preferably, the molten metal material is supplied to the gap or space as a filler metal which is separate from the metal material forming the convex portion 19. The filler metal is fused together with the surface of the convex portion 19 and become solidified and integrated. By the solidification of the molten metal, the weld bead 50 is formed around the outer peripheral portion of the convex portion 19, and the contact with the through hole 32 is increased.

Preferably, the cross-sectional area of the through holes 32 is increased toward the outside of the head.

More specifically, the through hole 32 is provided with a tapered portion 34 in which the cross-sectional area is gradually reduced toward the head main body 10 from its opening on the outer side of the head.

Thereby, the gap (space) for forming the weld bead 50 which is gradually expand toward the outside of the head can be formed between the through holes 32 and the convex portion 19. Thus, when the molten metal is supplied to such gap, it is easy for the molten metal to reach to a deeper position of the gap (a position near to the base of the convex portion).

Also, the tapered portion 34 of the through hole 32 of the insert 30 can be held down from the outer side of the head by the weld bead 50 formed in the gap. Therefore, it is possible to mechanically restrain movements of the insert 30 in the projecting direction of the convex portion 19, and thereby the generation of noise caused by vibrations of the insert 30 can be more reliably suppressed, while achieving lowering of the center of gravity of the golf club head 1.

It is effective to employ the tapered portion 34 of the through hole 32 together with the tapered portion 19*a* of the convex portion 19. But, it is also possible to employ the tapered portion 34 of the through hole 32 together with the convex portion 19 without the tapered portion 19*a*.

Preferably, edges of the surface 31 of the insert 30 facing toward the outside of the head are provided with first stepped portions 36 and second stepped portions 38 as shown in FIG. 10. Each of the first and second stepped portions 36 and 38 is a recessed portion recessed from the surface 31 in a stepwise manner.

In this embodiment, two first stepped portions 36 are disposed in the toe-side edge of the insert 30, one first stepped portion 36 is disposed in the heel-side edge of the insert 30, one second stepped portion 38 is disposed in the front edge of the insert 30, and one second stepped portion 38 is disposed in the rear edge of the insert 30.

Figure 12:
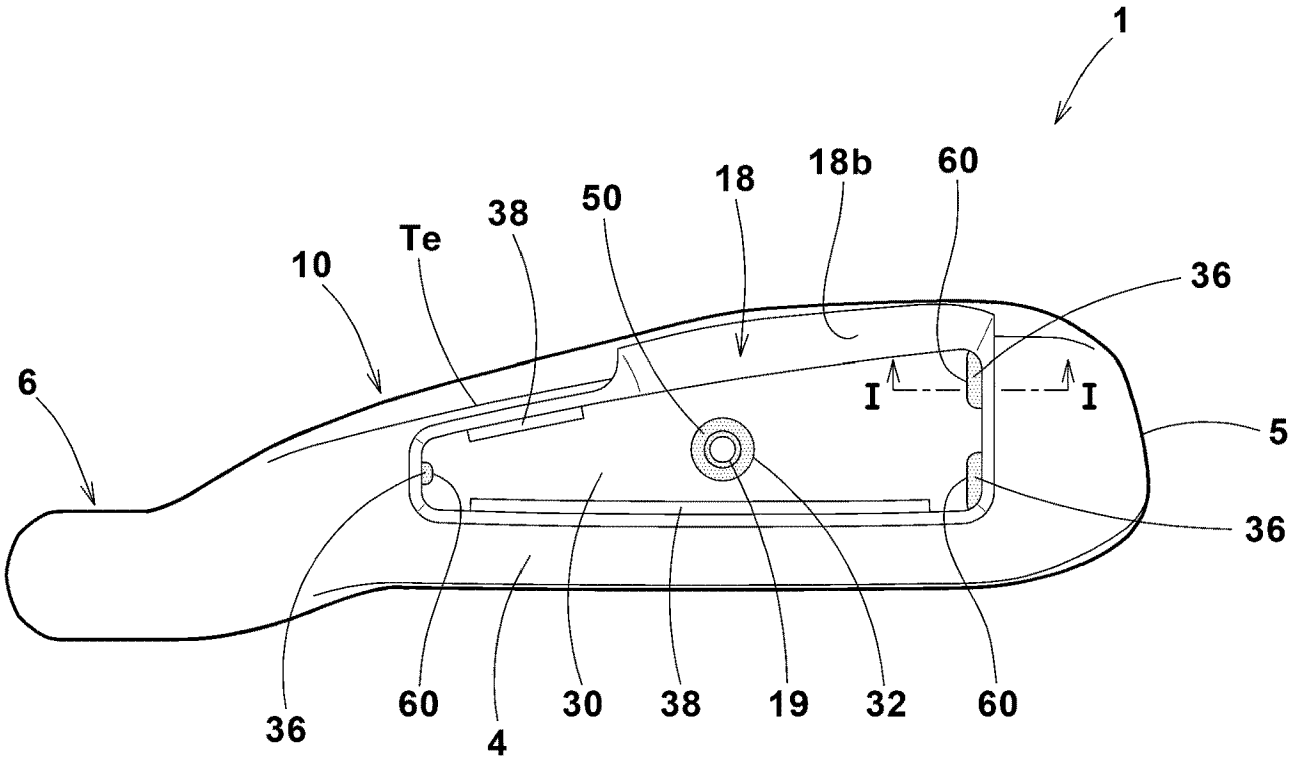
FIG. 12 is a bottom view of the head main body showing a state in which an insert is attached thereto.
Figure 13:
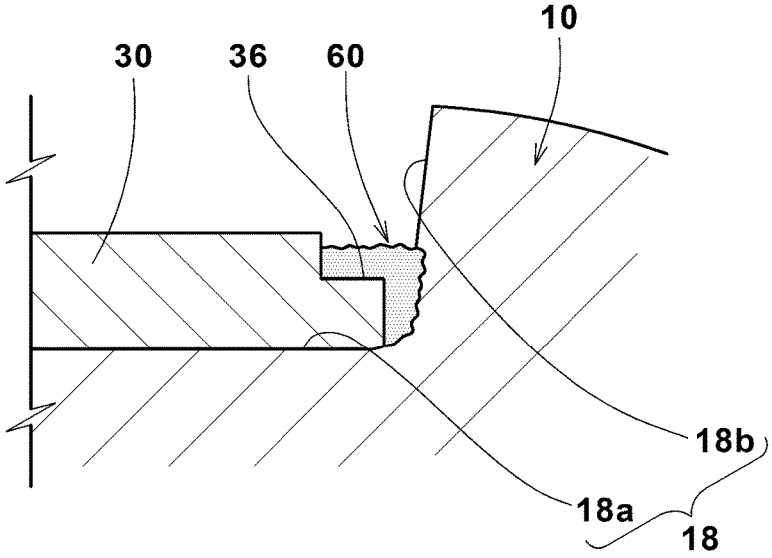
FIG. 13 is a cross-sectional view taken along line I-I in FIG. 12.
Figure 14:
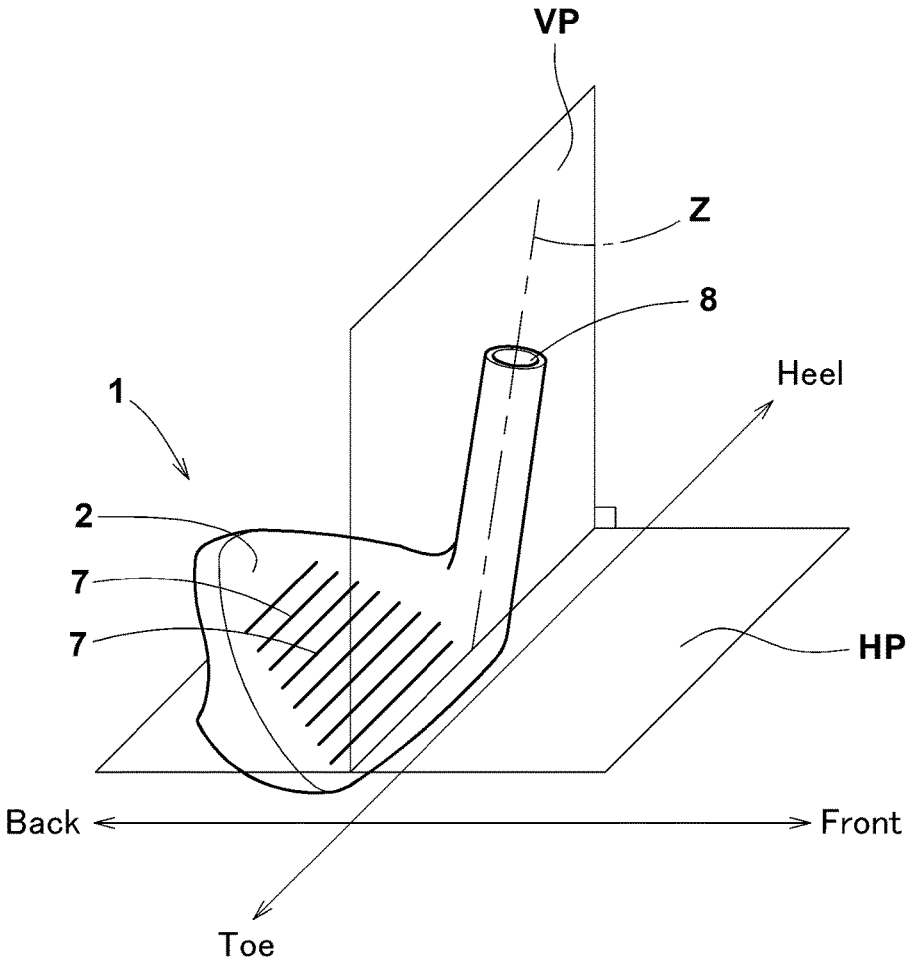
FIG. 14 is a schematic perspective view of a golf club head for explaining the standard state of the golf club head.

FIG. 12 is a bottom view of the head main body 10 in a state such that the insert 30 has been fitted into the recess 18, but the weight member 20 is not yet attached. FIG. 13 is a cross sectional view taken along line I-I of FIG. 12.

As shown, each of the first stepped portions 36 of the insert 30 is preferably covered with a weld bead 60 which is united with the recess 18.

The weld bead 60 is formed from a solidified molten metal which is weldable with the head main body 10, and a part thereof is fused and united with the surrounding wall 18*b* of the recess 18. A part of the weld bead 60 covers the first stepped portion 36 and fills up the space formed by the first stepped portion 36. Thereby, the weld bead 60 restrains the insert 30 from the outer side of the head.

Details are not shown but, the first stepped portion 36 provided in the heel-side edge is also covered with the weld bead 60.

In this embodiment, therefore, the weld beads 60 getting into the spaces of the respective first stepped portions 36 can more effectively suppress rattling or vibrations caused on the toe side and heel-side of the insert 30.

The above-mentioned weight member 20 is fixed to the recess 18 in such a state that the weight member 20 covers at least a part of the insert 30 from the outer side of the head as shown in FIG. 11.

The weight member 20 in this example has an inner surface 29 contacting with at least a part of the outer surface 31 of the insert 30.

The weight member 20 in this embodiment is disposed so as to cover the whole of the insert 30, and the insert 30 is disposed within the recess 18 without being exposed in the outer surface having the finished shape of the head.

Further, the peripheral edge of the weight member 20 is welded to the head main body 10, and the weld bead 40 is shown in FIG. 7. In order to increase the joint strength, the entire length of the peripheral edge of the weight member 20 is preferably welded to the head main body 10.

Preferably, each of the second stepped portions 38 of the insert 30 is covered with a part of the weld bead 40 which weld between the weight member 20 and the head main body 10. That is, when welding between the weight member 20 and the head main body 10, a part of molten metal runs through the gap between the weight member 20 and the head main body 10 (the surrounding wall 18*b* of the recess 18) and fills up the spaces formed by the second stepped portions 38 so as to cover the second stepped portions 38. Thus, the weld beads 40 can effectively prevent vibrations of the insert 30, and the generation of noise can be reliably suppressed. In this embodiment, since the second stepped portions 28 are formed in both the front edge and the rear edge of the insert 30 and covered with the weld beads 40, it is possible to more reliably suppress the generation of abnormal noise.

While detailed description has been made of preferable embodiments of the present invention, the present invention can be embodied in various forms without being limited to the illustrated embodiments. Needless to say, characteristic portions of respective embodiments can be exchanged between the embodiments.

DESCRIPTION OF THE REFERENCE SIGNS

1 iron-type golf club head
2 face
4 sole
6 hosel
9 back portion
10 head main body
20 weight member
21 first portion
22 second portion
Te trailing edge
Fc center of score lines

The invention claimed is:

1. An iron-type golf club head comprising:
a head main body including a face, a hosel, a sole and a back portion extending upward from a trailing edge of the sole, and
a weight member having a specific gravity larger than the head main body,
wherein:
the face is provided with score lines extending in a toe-heel direction of the head,
the weight member is disposed in the sole and extends in the toe-heel direction across a position in the toe-heel direction corresponding to a center position of the score lines,
the weight member integrally includes:
a base plate part formed in the form of a plate and having a width in a front-back direction of the head which is gradually increased toward a toe of the head from the heel-side, and
a rising part extending upward from a part on the toe-side of a rear edge of the base plate part so as to form a part of the back portion, and
the weight member comprises:
a toe-side first portion, as a part in the toe-heel direction having the rising part, extending over the sole and the back portion, and
a heel-side second portion, as a part in the toe-heel direction without the rising part, positioned on a heel-side of the toe-side first portion and extending within the sole.

2. The iron type golf club head according to claim 1, wherein a maximum thickness of the rising part measured in the front-back direction of the head is larger than a thickness of the base plate part.

3. The iron type golf club head according to claim 2, wherein a boundary between the toe-side first portion and the heel-side second portion is positioned on a heel-side of the center position of the score lines.

4. The iron type golf club head according to claim 1, wherein the rising part has an upper edge whose contour is smoothly and convexly curved upward, and a highest point of the contour is positioned on a toe-side of the center position of the score lines.

5. The iron type golf club head according to claim 4, wherein a boundary between the toe-side first portion and the heel-side second portion is positioned on a heel-side of the center position of the score lines.

6. The iron type golf club head according to claim 1, wherein a boundary between the toe-side first portion and the heel-side second portion is positioned on a heel-side of the center position of the score lines.

7. An iron-type golf club head comprising:
a head main body including a face, a hosel, a sole and a back portion extending upward from a trailing edge of the sole, and
a weight member having a specific gravity larger than the head main body,
wherein:
the face is provided with score lines extending in a toe-heel direction of the head,
the weight member is disposed in the sole and extends in the toe-heel direction across a position in the toe-heel direction corresponding to a center position of the score lines, and
the weight member integrally includes:
a toe-side first portion extending over the sole and the back portion, and
a heel-side second portion positioned on a heel-side of the toe-side first portion and extending within the sole without protruding into the back portion.

8. The iron type golf club head according to claim 7, wherein the weight member comprises:
a base plate part extending in the toe-heel direction of the head, while gradually increasing its width in a front-back direction of the head toward the toe of the head from the heel-side, and forming a part of the sole, and
a rising part extending upward from a toe-side portion of the base plate part, and forming a part of the back portion.

9. The iron type golf club head according to claim 8, wherein a boundary between the toe-side first portion and the heel-side second portion is positioned on a heel-side of the center position of the score lines.

10. The iron type golf club head according to claim 8, wherein a maximum thickness of the rising part measured in the front-back direction of the head is larger than a thickness of the base plate part.

11. The iron type golf club head according to claim 10, wherein the rising part has an upper edge whose contour is smoothly and convexly curved upward, and a highest point of the contour is positioned on a toe-side of the center position of the score lines.

* * * * *